United States Patent [19]

Romatzick

[11] Patent Number: 4,602,840

[45] Date of Patent: Jul. 29, 1986

[54] UNDER-CARPET CONNECTION SYSTEM

[75] Inventor: David H. Romatzick, Milford, Conn.

[73] Assignee: Harvey Hubbell Incorporated, Orange, Conn.

[21] Appl. No.: 616,156

[22] Filed: Jun. 1, 1984

[51] Int. Cl.[4] ..... H01R 11/20

[52] U.S. Cl. ..... 339/97 P; 29/869; 339/122 R; 339/176 MF

[58] Field of Search ..... 339/17 F, 97 R, 97 P, 339/98, 99 R, 176 MF, 122; 29/872, 869, 868

[56] References Cited

U.S. PATENT DOCUMENTS

| | | | |
|---|---|---|---|
| Re. 31,336 | 8/1983 | Weinmann et al. | 29/868 |
| 2,079,274 | 5/1937 | Baker | 247/39 |
| 2,611,800 | 9/1952 | Naughton | 173/334.1 |
| 2,749,382 | 6/1956 | Lockard | 174/71 |
| 3,150,909 | 9/1964 | Deverell | 339/17 F |
| 3,168,617 | 2/1965 | Richter | 174/117 |
| 3,253,085 | 5/1966 | Stern | 174/117 |
| 3,281,759 | 10/1966 | Emerson | 339/97 P |
| 3,408,453 | 10/1968 | Shelton, Jr. | 174/68.5 |
| 3,524,921 | 8/1970 | Wolf | 174/70 |
| 3,576,941 | 5/1971 | Colglazier | 174/117 |
| 3,715,457 | 2/1973 | Teagno et al. | 174/88 R |
| 3,763,307 | 10/1973 | Wolf | 174/117 FF |
| 3,808,456 | 4/1974 | Kay et al. | 307/140 |
| 4,012,093 | 3/1977 | Crane | 339/176 MF |
| 4,023,882 | 5/1977 | Pettersson | 339/96 |
| 4,045,750 | 8/1977 | Marshall | 333/6 |
| 4,219,928 | 9/1980 | Kuo | 29/868 |
| 4,240,687 | 12/1980 | Bunnell et al. | 339/99 R |
| 4,240,688 | 12/1980 | Sotolongo | 339/122 F |
| 4,249,303 | 2/1981 | Weinmann et al. | 29/868 |
| 4,256,359 | 3/1981 | Storck | 339/97 C |
| 4,258,974 | 3/1981 | Kuo et al. | 339/97 R |
| 4,283,593 | 8/1981 | Piasecki et al. | 174/36 |
| 4,289,370 | 9/1981 | Storck | 339/125 R |
| 4,315,662 | 2/1982 | Greenwood et al. | 339/97 C |
| 4,319,075 | 3/1982 | Willette | 174/117 FF |
| 4,371,225 | 2/1983 | Narozny | 339/97 C |
| 4,381,420 | 4/1983 | Elliott et al. | 174/34 |
| 4,387,949 | 6/1983 | Haitmanek | 339/125 R |
| 4,417,096 | 11/1983 | Willette | 174/71 R |
| 4,463,998 | 8/1984 | Reavis et al. | 339/122 R |
| 4,470,656 | 9/1984 | Moser et al. | 339/176 MF |

FOREIGN PATENT DOCUMENTS

| | | |
|---|---|---|
| 1047764 | 11/1963 | United Kingdom . |
| 1024525 | 1/1965 | United Kingdom . |

*Primary Examiner*—Gil Weidenfeld
*Assistant Examiner*—Paula A. Austin
*Attorney, Agent, or Firm*—Jerry M. Presson; Walter C. Farley

[57] ABSTRACT

A flat cable system includes at least three types of insulated cables with flat conductors, the conductor spacing being either a distance D or a multiple thereof. A connector block for electrically connecting the cables to each other or to wires leading to outside devices includes upper and lower plastic blocks, the lower block having recess with internally threaded backing nuts therein in a staggered pattern, the nuts being spaced by distances D. The upper block carries a puncturing member, a threaded bolt, a spring washer and a terminal connected to a wire. The bolt has a drill point to penetrate one or more cables and threadedly engage one of the backing nuts, forming a clamp assembly which forces the puncturing member into electrical contact with the conductor. An intermediate board for interconnecting plural cables is disclosed.

20 Claims, 29 Drawing Figures

120

121

122

UNDER-CARPET CONNECTION SYSTEM

This invention relates to a flat cable wiring system for providing wiring in locations such as beneath carpet and behind paneling and, in particular, to connection devices usable to provide power to or from the cable and to or from various loads.

BACKGROUND OF THE INVENTION

Wiring systems using flat cable fall into two major categories. One category includes those devices designed for use in carrying data signals and the like. The cables, connectors, and related devices in this category are designed to deal with relatively large numbers of wires of rather small size to handle information signals and associated low-level power, usually in the order of a few volts with currents generally much less than one ampere.

The other category, to which the present invention relates, involves supplying power to outlets, switches, lighting fixtures and other forms of load devices for operating home and business appliances. The overall objective of the systems in this category is to devise a practical, safe and reliable way of delivering power line voltage and current (i.e., 120 volts, 240 volts or higher at currents of up to about 30 amperes) from one location in a room to another location without the need for structural modifications of the walls or floor and without being limited to locations where subfloor wiring channels were positioned when the structure was initially built. In theory, under-carpet cable could permit great flexibility in room arrangements, particularly office arrangements, by allowing outlets to be installed at nearly any locations in the room.

Some such systems have been proposed and examples of prior systems are found in the following patents.

| | | | |
|---|---|---|---|
| 3,524,921 | Wolf | 4,258,974 | Kuo et al |
| 3,763,307 | Wolf | 4,289,370 | Storck |
| 4,219,928 | Kuo | 4,315,662 | Greenwood et al |
| 4,240,687 | Bunnell et al | 4,371,225 | Narozny |
| 4,240,688 | Sotolongo | 4,387,949 | Haitmanek |
| 4,249,303 | Weinmann et al | Re. 31,336 | Weinmann et al |

Previous systems have been found to have several shortcomings including the difficulty of interconnecting the conductors, requiring preparation of the cable by, for example, forming holes therein in a particular pattern using a template or a special tool. This not only requires special, rather complex equipment but also raises the problem of subsequent alignment with those holes.

BRIEF SUMMARY OF THE INVENTION

Accordingly, an object of the present invention is to provide an improved under-carpet cable system which is extremely simple and quick to install and which requires no costly or complicated installation equipment.

A further object is to provide such a system which mates well with existing standard outlet boxes and which can readily be adapted to several operating circumstances.

Yet another object is to provide a cable system having a transition or interconnection unit which requires no stripping, skinning or puncturing of the flat cable in advance of installation.

A still further object is to provide a transition connector for providing connections between the flat conductors of a flat cable and conventional "round" wires.

Another object is to provide such a transition connector for interconnecting the flat conductors of two or more flat cables with or without connections to other wires.

Yet another object is to provide such a system which does not sacrifice any reliability or safety but, on the contrary, is a highly reliable, sturdy, safe and effective system.

Briefly described, the invention comprises an apparatus for making electrical connections to a flat cable of the type having a plurality of flat conductors lying in substantially the same plane in parallel, spaced relationship and covered by insulating material, the apparatus comprising a first body of electrical insulating material having a first surface, the first body having a plurality of backing members carried therein with each of the backing members having a surface adjacent to and facing in the same direction as the first surface and having an internally threaded hole therein. A second body of insulating or dielectric material has generally parallel second and third surfaces and has a plurality of puncturing members carried therein, each of the puncturing members having a toothed edge at one end thereof protruding beyond the second surface and having a driving edge at the other end protruding beyond the third surface. A plurality of elongated bolts extend through the second body and the puncturing members, each of the bolts having an enlarged head at one end, external threads at the other end dimensioned to threadedly engage threads in the second body and subsequently the threads in one of the backing members, and a non-threaded portion for threaded disengagement with the second body. A spring washer surrounds the non-threaded portion for transmitting pressure from the bolt head against the driving edge of one of the puncturing members. The first and second bodies can be assembled with the flat cable between the first and second surfaces and with one of the bolts penetrating each of the conductors so that the threaded end thereof engages one of the backing members and so that the bolt head, acting through the washer, presses the toothed edge through one surface of the cable insulating material into electrical contact with one of the conductors, the other surface of the cable being held against one of the backing members.

Each of the elongated bolts has a means for easy penetration of the conductors.

Another aspect of the invention comprises a transition unit for making electrical connections between a plurality of individual wires and the flat conductors in a flat cable including a number of penetration devices for extending through holes in the conductors of the flat cable and for making electrical and mechanical contact with the conductors, and terminal devices for electrically connecting the wires to the penetration devices. A support structure of electrical insulation material supports the penetrating devices in lateral alignment with the flat conductors in the cables but longitudinally offset from each other to provide adequate separation diagonally between conductive components of the penetration and terminal devices. However, the overall transverse (with respect to the cable) dimensions of the transition unit are less than the dimensions of a NEMA standard outlet box.

BRIEF DESCRIPTION OF THE DRAWINGS

In order that the manner in which the foregoing and other objects are attained in accordance with the invention can be understood in detail, particularly advantageous embodiments thereof will be described with reference to the accompanying drawings, which form a part of the specification, and wherein.

DETAILED DESCRIPTION OF PREFERRED EMBODIMENTS

Figure 1:
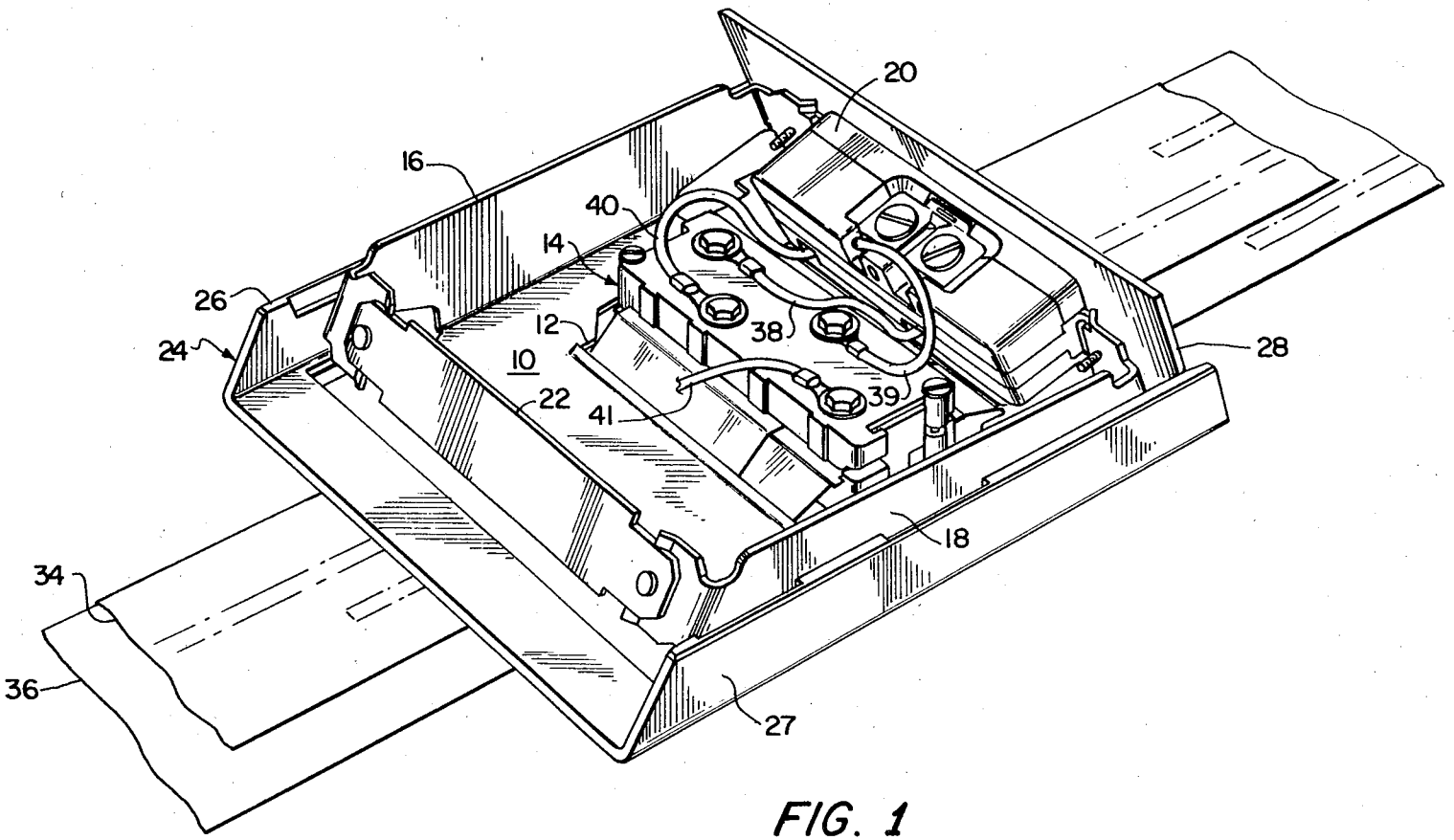
FIG. 1 is a perspective view of a partially installed apparatus in accordance with the present invention.
Figure 2:
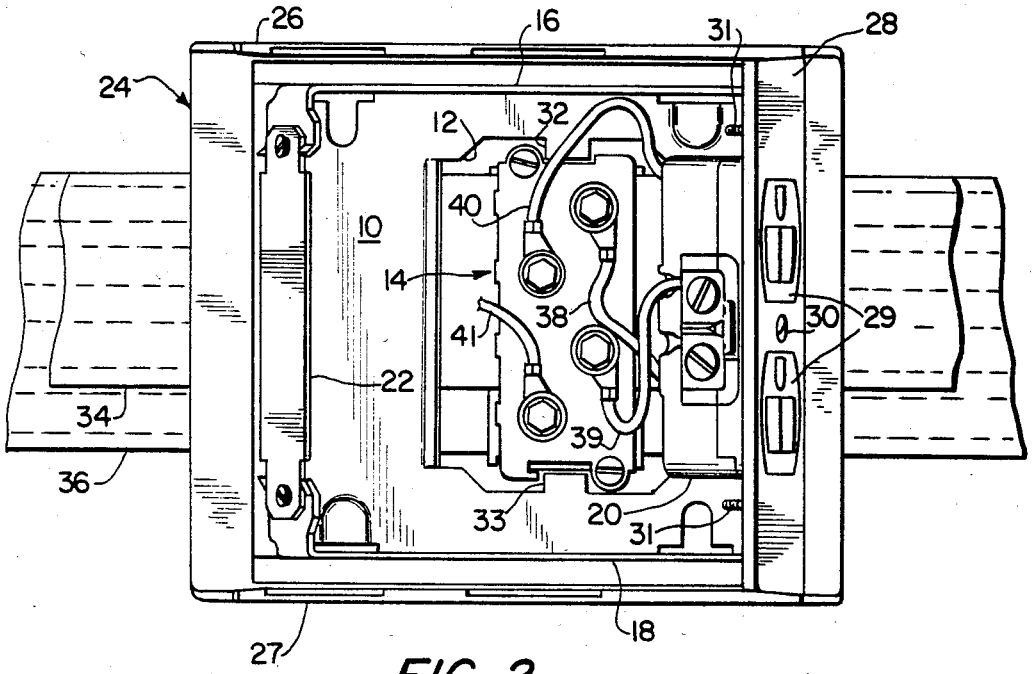
FIG. 2 is a top plan view of the apparatus of FIG. 1.
Figure 3:
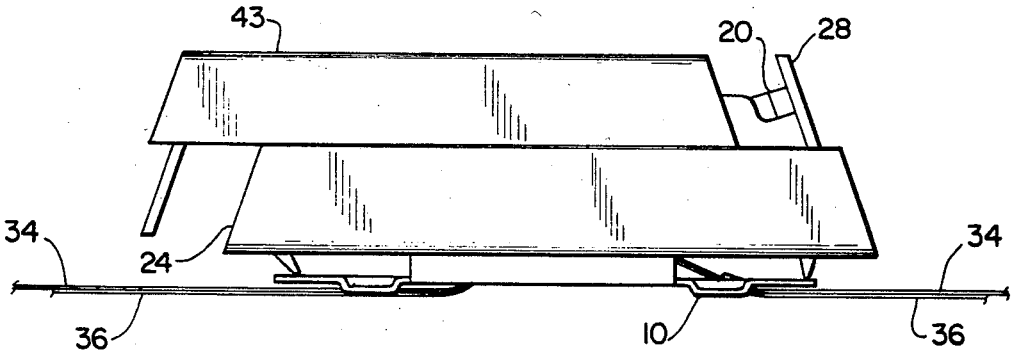
FIG. 3 is a side elevation of the apparatus of FIGS. 1 and 2 with a cover portion of the housing thereof in place.

FIGS. 1, 2 and 3 show perspective, top plan and side elevations of an apparatus in accordance with the invention in a partially assembled form substantially as it would appear in a use location during installation. The assembly includes a base plate 10 which can be attached to the surface on which the assembly is being mounted. Most often, this is a concrete or wooden floor on which there is or will be carpet. Plate 10 has a central opening 12 to receive a transition or connector assembly 14, which is illustrated in a somewhat simplified form but which will be described in greater detail. Plate 10 also has upstanding side walls 16 and 18, the ends of which are bent inwardly so as to extend toward each other and define a gap in which a receptacle or other electrical device can be mounted.

In the specific device illustrated, a conventional receptacle 20 is mounted at one end of the plate in the gap between the side walls and a support plate 22 is mounted at the other end. Plate 22, in the illustration, is essentially a dummy plate to fasten housing portion 43 in the absence of another electrical device. It can be replaced by a receptacle or any other form of device, as desired. However, plate 22 is dimensioned and configured to be usable to mount a transition block in an outlet box for quite another set of conditions, as will be described. A first housing portion 24 surrounds plate 10 and includes upwardly extending side wall 26 and 27 and an inclined end wall 28. As will be recognized from FIG. 3, the inwardly bent ends of the side walls are inclined at the same angle as wall 28 to make a solid connection and wall 28 is inclined to present a pleasing appearance and also to make the face of the connector more easily visible, particularly when the device is to be disposed adjacent a desk or the like. End wall 28 is provided with apertures to permit the usual bosses 29 on receptacle 20 to extend therethrough, the bosses being the portions which surround the openings in the receptacle spaced and dimensioned to receive mating plug blades. End wall 28 is attached to receptacle 20 by a screw 30 and the receptacle is, in turn, connected to the inwardly bent portions at the ends of the side walls by screws 31.

As best seen in FIG. 2, connector assembly 14 has vertically extending recesses at both ends to receive tongues 32 and 33 which extend toward each other from opposite sides of opening 12 in plate 10. The tongues loosely position connector 14 within the opening, allowing it some freedom to slide vertically.

Flat cables 34 and 36 extend beneath plate 10, pass through connector 14 and, in the particular arrangement shown, leave the opposite side. In the specific example shown, cable 34 is a three-conductor cable having flat conductors coded white, green and black. Cable 36 is a four-conductor cable having flat conductors labeled white, green, black and red. In a manner which will be explained in detail, conductors of like color code are interconnected within connector 14 and they are also connected to wires 38, 39, 40 and 41 which are attached to the top of the connector. Three of those wires 38, 39 and 40, coded white, black and green, are attached to receptacle 20 which is therefore electrically powered by a branch circuit which can be referred to as a black branch. The unused red wire 41 is taped off or can be connected to a receptacle at the other end of the housing, which receptacle would then be connected to the red branch of the power circuit.

As seen in FIG. 3, the assembly is completed by the insertion of a second housing portion 43 which is made to mate with housing portion 24 as illustrated. The inclined end of housing portion 43 is provided with punch-outs to form openings for an electrical device such as another receptacle. A different cover portion can be substituted, if desired, with openings or punch-outs to receive a communication connector or connectors so that the entire assembly can accommodate both power and communication lines. Cables 34 and 36, however, are power only. Housing portions 24 and 43 are preferably molded from a suitable polymeric material to present a pleasing appearance while being sturdy and impact resistant.

Before discussing the details of transition assembly 14, some basic functions of the system should be recognized. One very important function is to connect the conductors of a flat cable to conventional wires such as wires 38–41 which can be referred to as "round" wires as they normally are. The round wires can be either the input or output wires, i.e., they can be delivering power to the flat cable or can be delivering power from the flat cable to a load.

A second function is to interconnect one multiconductor flat cable with another multiconductor flat cable having the same or a different number of conductors.

These two functions can be combined as illustrated in FIGS. 1–3. Regardless of which functions are being performed, it will be recognized from the following descriptions that assembly and installation is greatly improved and simplified as compared with the prior art because, in part, there is no advance preparation of the flat cable. The cable need not (indeed, must not) be stripped or skinned and there is no punching or drilling of holes through the cable before assembly.

The techniques employed in the present invention thus save considerable time at the point of installation and avoid difficulties which arise when pre-punching is needed, particularly in aligning the pre-made holes.

It is also very significant that the assembly is dimensioned so that it can be used with a NEMA standard outlet box.

Figure 4:
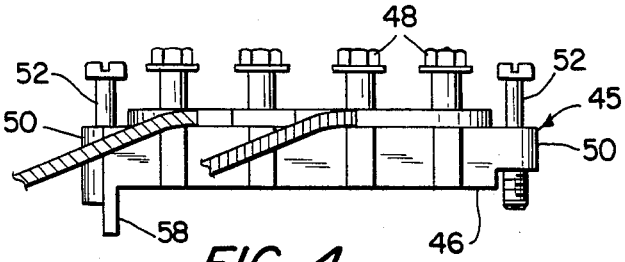
FIG. 4 is a side elevation of an upper body portion of a connector assembly or transition unit.
Figure 5:
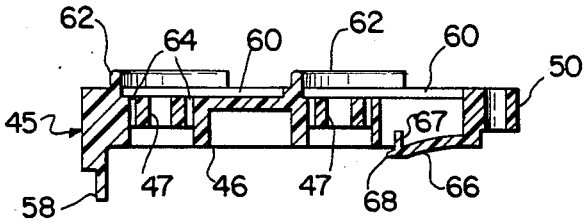
FIG. 5 is a longitudinal sectional view of the body of FIG. 4.
Figure 6:
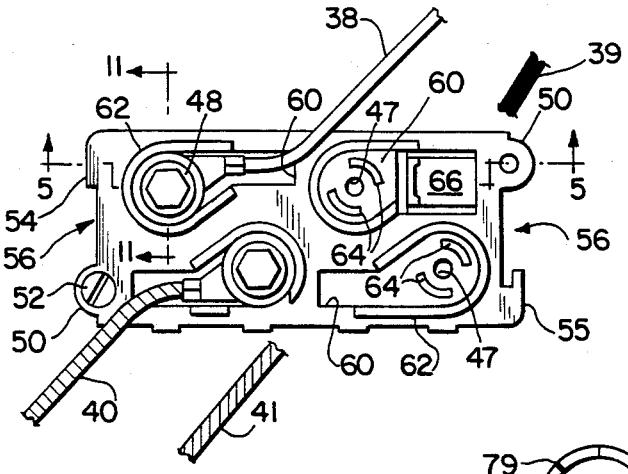
FIG. 6 is a top plan view of the apparatus of FIG. 4 with some hardware elements removed.
Figure 13:
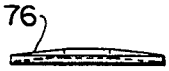
FIG. 13 is a side elevation of a Belleville spring washer usable in the apparatus of FIG. 11.

FIGS. 4, 5 and 6 show three different views of a first body of dielectric material 45 which comprises the upper portion of connector assembly 14. Body 45 has a lower surface 46 which, in the assembled structure, will face and be in contact with the upper surface of one of the flat cables. Body 45 has a plurality of holes 47 therethrough to receive bolts 48 which will extend through the cable. At the ends of body 45 are protrusions 50 having openings therethrough to receive fastening bolts or screws 52 which are used to attach the upper and lower portions of the connector assembly to each other. It will be noticed that protrusions 50 are at opposite corners of body 45 and that the remaining corners have lugs 54 and 55, thereby defining with protrusions 50 recesses 56 which receive tongues 32 and 33 as previously described. In addition, lug 55 has a further recess defining a hook-like shape to receive an alignment tab projecting upwardly from the bottom portion of the connector assembly. A downwardly extending tab 58 extends below surface 46 and is dimensioned to be received in a mating recess in the lower portion of the connector assembly. Tab 58, together with the tab on the bottom portion cooperate with mating recesses to assure assembly of the bodies in a unique, proper orientation.

The upper surface of body 45 is provided with four recesses 60 which are shaped and dimensioned to receive the ends of wires 38–41 and their associated terminals. Each of the terminals is a rather conventional eye terminal with a crimp connection to the stripped end of its associated wire. Each recess 60 is partially surrounded by a curved wall 62, unitarily molded onto body 45, which assists in the positioning of each wire terminal and separates the recesses and the terminals from each other to minimize the possibility of contact or arcing in the event of a loose terminal.

It will also be observed that holes 47 and recesses 60 are staggered or offset in the longitudinal direction of the flat cable with which it will be used. This staggering arrangement permits alignment of holes 47 with the cable conductors and greatly increases the spacing between conductive parts for improved longterm electrical performance.

Openings 47 are essentially centered in the circular portions of recesses 60 and receive bolts 48. Partially surrounding openings 47 are pairs of arcuate slots 64, each slot occupying approximately 90 degrees of arc and being separated from the other slot by approximately the same angle. As seen in FIGS. 5 and 6, a spacing tab 66 protrudes slightly below surface 46, tab 66 having a stop wall 67 extending upwardly therefrom and a lip 68 protruding essentially parallel with surface 46. The purpose of spacing tab 66 is to provide a definite positioning member when three-conductor cables are used with only the white, black and green conductors therein. Tab 66 keeps the cable positioned between stop tab 67 and the inwardly facing surface of tab 58 when the red conductor 41 and its associated terminal is not to be connected to a cable.

Figure 11:
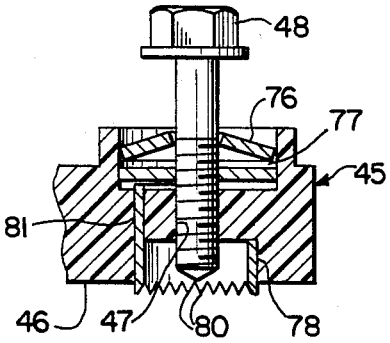
FIG. 11 is a partial sectional view along line 11—11 of FIG. 6.
Figure 12:
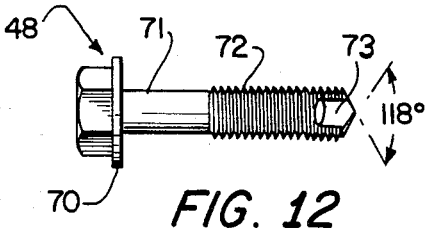
FIG. 12 is a detail of a penetrating bolt used in the apparatus of FIGS. 4, 6 and 11.

FIG. 11 shows in greater detail the relationship between body 45, bolt 48 and the other components which are associated with the upper body and are involved in forming an electrical connection with a flat cable. As seen in both FIGS. 11 and 12, bolt 48 has an enlarged head portion 70 with a flat undersurface, a smooth, unthreaded portion 71 and a threaded portion 72. The distal end of the threaded portion terminates in a tip resembling a twist drill, having an insulation-receiving recess 73 extending therein and end surfaces separated by an angle of approximately 118 degrees and having flutes 74 on opposite sides thereof, terminating in sharp edges which can perform a kind of drilling function.

In the embodiment shown, the length of unthreaded portion 71 is 0.290 inches, the length of threaded portion 72 is 0.530 and the thickness of the portion of body 45 through which hole 47 extends is about 0.210 inches. Additionally, the lower surface of the portion containing hole 47 is recessed 0.135 inches in from surface 46. These dimensional relationships are quite important to the proper operation of the structure during assembly because the tip of screw 49 is used to form its own hole through the flat conductor with which it is aligned, as will be described subsequently.

The assembly further includes a spring washer 76 which is of the type commonly known as a Belleville washer. When bolts 48 and the other components are assembled into body 45, each bolt is passed through the central opening of washer 75, through the eye of a terminal 77, and is then threaded into the material of body 45 forming threads in the wall of opening 47. Body 45 is preferably made from a moldable plastic material such as nylon and bolt 48 can therefore be easily threaded therein, threaded portion 72 forming its own threads in the plastic upon insertion. The bolt can be allowed to remain in the position illustrated in FIG. 11 until the time comes for final assembly of the structure, on site.

Figure 14:
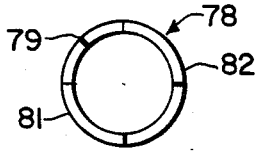
FIGS. 14 and 15 are top plan and side elevation views, respectively, of a puncturing member usable in the apparatus of FIG. 11.
Figure 15:
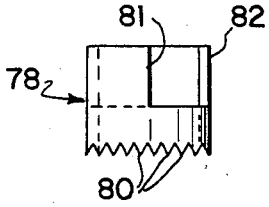

This portion of the assembly also includes a plurality of puncturing members 78, one of which is illustrated in FIGS. 14 and 15. As seen therein, each puncturing member is a substantially cylindrical body made of a relatively hard metal having good electrical conductivity characteristics such as a bronze alloy. The cylindrical body can be formed by bending a sheet of material around a mandrel, leaving a relatively narrow gap 79 at one side thereof. The lower portion of the puncturing member is thus a substantially continuous cylinder having a plurality of serrations or teeth 80 at the lower end thereof. Axial extensions 81 and 82 protrude upwardly from the cylindrical portion, each of these extensions having an arcuate extent of approximately 90 degrees and being shaped and dimensioned to be insertable into arcuate slots 64 in body 45. It will be observed that the axial length of puncturing member 78 is greater than the distance between the bottom of recess 60 and surface 46.

An alternative technique for forming a puncturing member comprises forming a cylindrical body of conductive material such as brass with an enlarged noncircular flange at one end. A partially threaded opening extends axially through the body, the threads occupying about half of the length of the opening at the nonflanged end. A disk-like member with teeth around its edge and with a central opening is staked or otherwise attached at the flanged end coaxially with the opening. To receive a member of this type, body 45 is formed with a cylindrical hole to mate with the cylindrical body and a noncircular recess adjacent surface 46 to match the flange.

Figure 7:
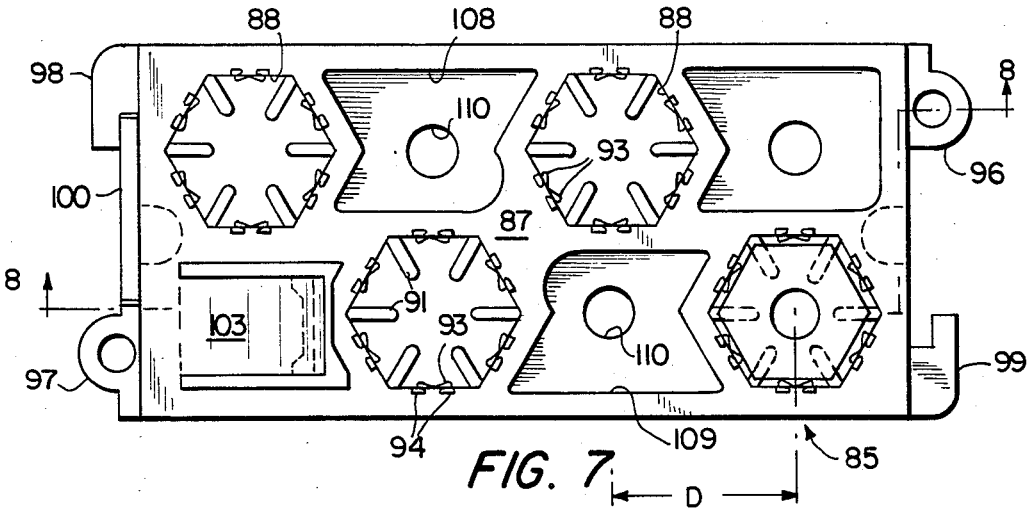
FIG. 7 is a top plan view of a lower dielectric body of the connector or transition assembly.
Figure 8:
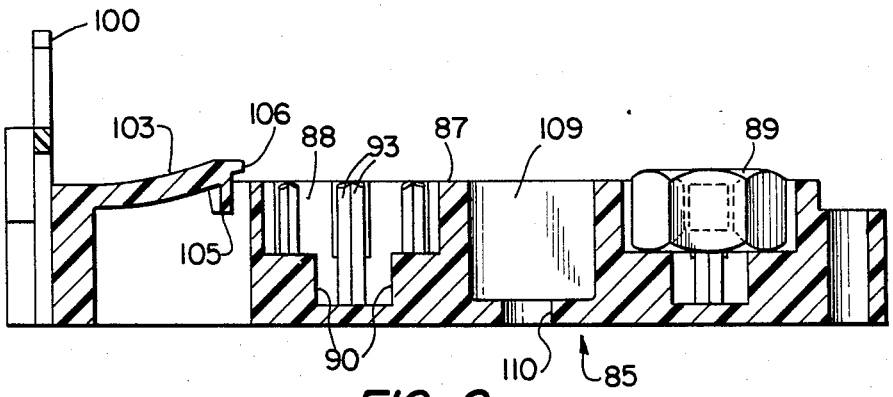
FIG. 8 is a side elevation, in section, along line 8—8 of FIG. 7.
Figure 9:
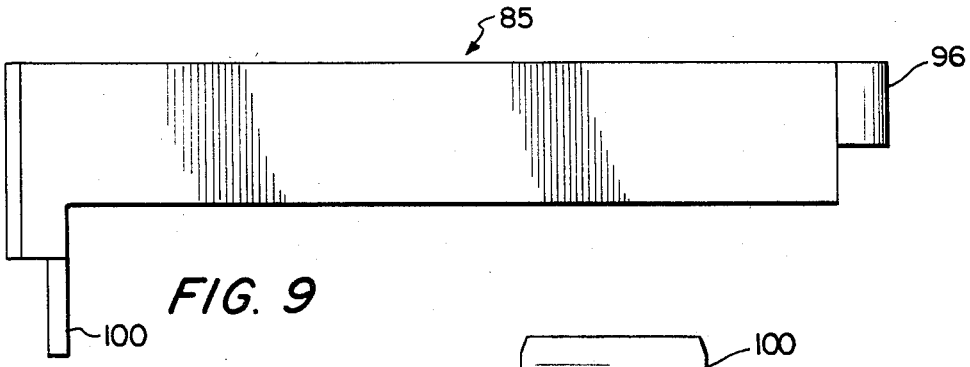
FIG. 9 is a rear side elevation of the body of FIG. 7.

Turning now to FIGS. 7, 8 and 9, these figures show the bottom portion of connector assembly 14 which comprises a second body of dielectric material indicated generally at 85 having an upper surface 87 with a plurality of recesses 88, each recess being generally hexagonal to receive a backing member 89 which, in the present embodiment, is an internally threaded nut. Within each recess 88 are six radially inwardly extending walls 91 having upper surfaces which are spaced from upper surface 87 a distance less than the thickness of nut 89. Thus, when nut 89 is inserted into one of the recesses, its lower surface rests on walls 90 and its upper surface protrudes above surface 87. The central portion of recess 88 between the inner distal edges of walls 90 forms a space which can receive the end of a bolt, as will be further described.

Walls 91 protrude inwardly from the corners of the hexagonal recess and, along the flat surfaces between those corners, the recess walls are provided with V-shaped inwardly protruding flexible fingers 93 in pairs, the fingers being part of a small Y-shaped molded body protruding inwardly from small axial recesses 94 axially extending along the walls. Fingers 93 protrude inwardly to engage the flat sides of nut 89 to hold the nut in the recess when it is inserted without any additional fastening means being required. However, fingers 93 do not hold the nut rigidly. Rather, the fingers are capable of a limited degree of resilient motion which allows nut 89 to move laterally and axially and also allows it to tilt within its recess. This becomes very important during the assembly process.

At one end of body 85 is a rounded protrusion 96 having an opening to receive a mounting screw, and at the opposite diagonal corner is a similar protrusion 97. At the opposite corners are lugs 98 and 99 which, together with the rounded protrusions form recesses which are aligned with recesses 56 of body 45. As seen in FIGS. 8 and 9, a tab 100 extends upwardly beyond surface 87 to engage the recess 56 adjacent hook-shaped member 55. Also, lug 99 has a hook shape to receive tab 58 on body 45. When thus assembled, screws 52 can pass through the openings in protrusions 50 and also 96 and 97. As previously mentioned, tabs 100 and 58 key the two bodies together so that they can only be assembled in one orientation.

Figure 10:
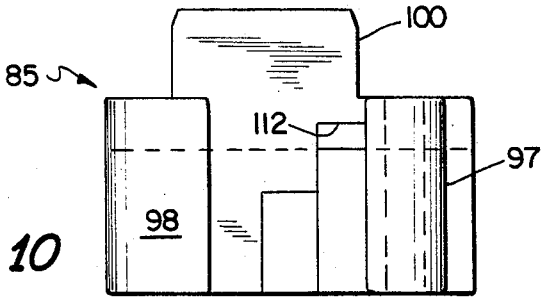
FIG. 10 is an end elevation of the body of FIGS. 7-9.

Body 85 also has a spacing tab 103 with a perpendicularly extending stop tab 105 and a horizontal lip 106 which function in the same fashion as the spacing tab and related components on body 45. When bodies 45 and 85 are assembled together with tabs 58 and 100 in the associated recesses on the opposite components, the outwardly facing surfaces of lips 68 and 106 abut each other when a narrow, three-conductor cable is placed in the assembly. When a four-conductor cable is placed therein, spacing tabs 66 and 103 are bent inwardly to the adjacent recesses so that the surfaces thereof no longer protrude beyond their associated surfaces 46, 87. Intermediate recesses 108 and 109 contain openings 100 through which mounting bolts can be inserted. As will also be seen in FIG. 10, a rectangular opening 112 is formed between the material of tab 100 and protrusion 97 to receive an alignment tab of an intermediate member which will be subsequently described.

Figure 16:
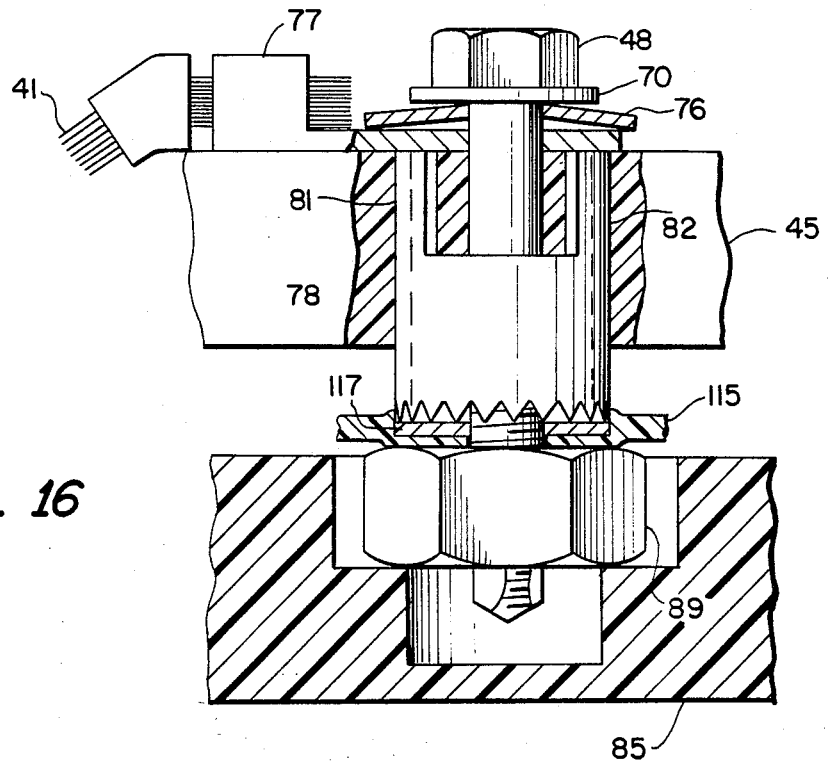
FIG. 16 is a partial side elevation, in section, of a portion of the connector assembly.

When bodies 45 and 85 are assembled with a flat cable 115 therebetween, the sides of the cable are positioned between the inner surface of tab 58 and the inner surface of tab 100, in the case of a four-conductor cable, or between the inner surface of tab 58 and the protruding portions of spacing tabs 66 and 103 in the case of a three-conductor cable. In either event, a conductor 117 within cable 115 is positioned below each of either 3 or 4 of the bolt and puncturing member assemblies as illustrated in FIG. 11 and above one of the backing member nuts 89 shown in FIG. 8. This assembly, illustrated in assembled form in FIG. 16, is arranged so that the drill point of a bolt 48 can form a hole through the insulation and conductor 117 which is below it and so that the threaded portion 72 of the bolt can proceed to be threaded into the internally threaded hole through nut 89.

The exact sequence of events which occurs in the assembly process is quite significant. Assume for purposes of explanation that a single, four-conductor flat cable is to be connected to wires such as wires 38–41. The cable is placed on the upper surface 87 of a body 85 and a body 45 is placed on top of the cable with tab 58 entering the recess between protrusion 96 and lug 99, and with tab 100 entering recess 56 between protrusion 50 and lug 55. Screws 52 are then threaded through the openings in protrusions 50, 96 and 97 to hold the two bodies together with the cable sandwiched in between them. Although screws 52 do not play a critical role in maintaining the assembly in assembled condition after installation, they are very important in the initial stages because they hold the two bodies together while holes are being formed through the flat conductors.

The next step is rotation of the bolts 48, one at a time, to thread them further into holes 47. The length of thread described previously in the description of bolt 48 is sufficiently long so that a substantial portion of the thread is still engaged in hole 47 when the tip of bolt 48 comes into contact with the flat cable and starts to make a hole therein, and that threaded engagement continues until the bolt forms a hole completely through the cable conductor and insulation and the tip of the bolt enters the internally threaded hole in nut 89. While the hole is being formed, the reaction force resulting from the pressure of the bolt point against the cable is transferred by the threads in hole 47 to body 45, tending to push body 45 away from body 85. This separation tendency is resisted by bolts 52. However, bodies 45 and 85 can undergo some elastic deformation during this stage of assembly, and tend to bow away from each other.

The hole forming itself is a process somewhat similar to reaming as to the insulation material of the cable in the sense that the faces of the bolt point, separated by 118°, tend to scrape the insulation away and push it radially outwardly from the hole location. This is especially important as to the lower layer of insulation because the insulation is carried down into the threads of nut 89 and is received in recess 73.

After bolt 48 penetrates the conductor and the insulation and begins to threadedly engage nut 89, the upper end (closest to the head) of threaded portion 72 emerges from hole 47, leaving the unthreaded portion therein which can move axially relative to the hole.

The threaded engagement between nut 89 and the bolt can be complicated somewhat by the distortion of the bodies described above such that the bolt axis is not precisely coaxial with the nut axis and so that the bolt thread may not be located exactly at the beginning of the nut thread. However, because of the flexibility of fingers 93 and the above-described ability of nut 89 to move and tilt within recess 88 without being released therefrom, the nut can tilt and otherwise adapt to slightly different positions of bolt 48, permitting the threads to engage. In addition, the energy stored by the elastic deformation of bodies 45 and 85 acts to force the tip of bolt 48 into initial threaded engagement with nut 89.

As mentioned in connection with FIG. 11, bolt 48 passes through a Belleville washer 76 and through the eye opening in a terminal 77 to which a wire such as wire 41 is connected. Washer 76 presses downwardly on the upper surface of the terminal which abuts the upper end surfaces of axial extensions 81 and 82 of puncturing member 78. Because the threaded portion of bolt 48 is engaging the internal threads in nut 89, and because the upper surface of that nut is pressing upwardly against the lower surface of cable 115, teeth 80 of the puncturing member are pressed into the insulation above conductor 117, puncturing that insulation and coming into engagement with the conductor itself. This forms a clamping assembly, extending from nut 89 to the enlarged portion 70 of bolt 48, which does not depend in any way upon the strength or other characteristics of the polymeric material forming bodies 45 and 85. The connection is through the metal components forming the bolt, Belleville washer 76, terminal 77, puncturing member 78, the conductor 117 itself, and nut 89 with the Belleville washer acting to maintain the force even if vibration or some other event should cause the bolt to loosen. This structure avoids the provlems which have been found to occur with some prior art structures wherein a portion of the electrical contact engagement force depends upon polymeric material which can undergo cold flow and other distortions resulting from varying temperature conditions and the like. The only plastic material which remains in this clamping assembly is the relatively thin layer of insulation on the lower or back surface of cable 115 between conductor 117 and the upper surface of nut 89. When the members are first tightened together as described, that thin layer may undergo some elastic deformation but soon reaches an elastic limit. However, with the passage of time, cold flow of that insulation material can occur, causing the clamping force to be reduced. The presence of Belleville washer 76 compensates for that cold flow and prevents any undesirable loosening as a result of that phenomenon.

Figure 17:
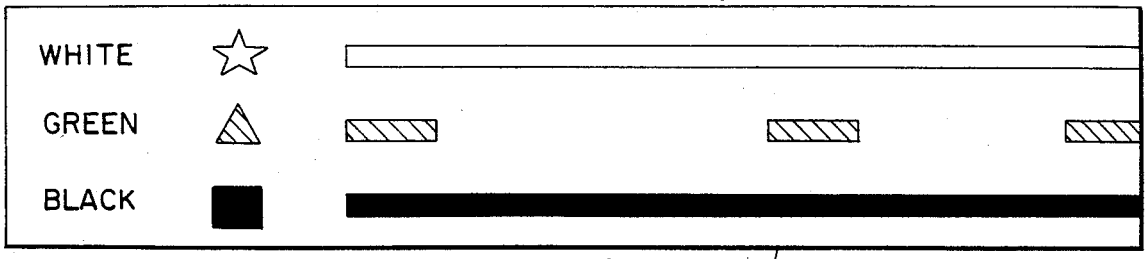
FIGS. 17, 18 and 19 are top plan views of cable arrangements in accordance with the present invention.
Figure 18:
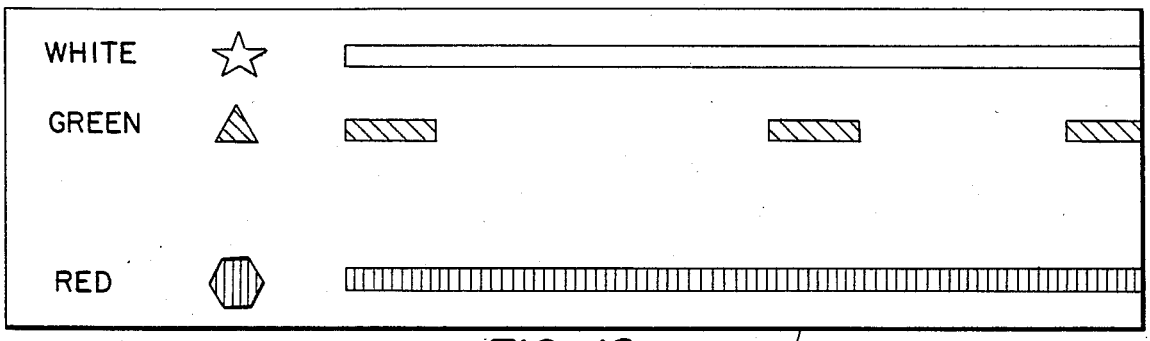
Figure 19:
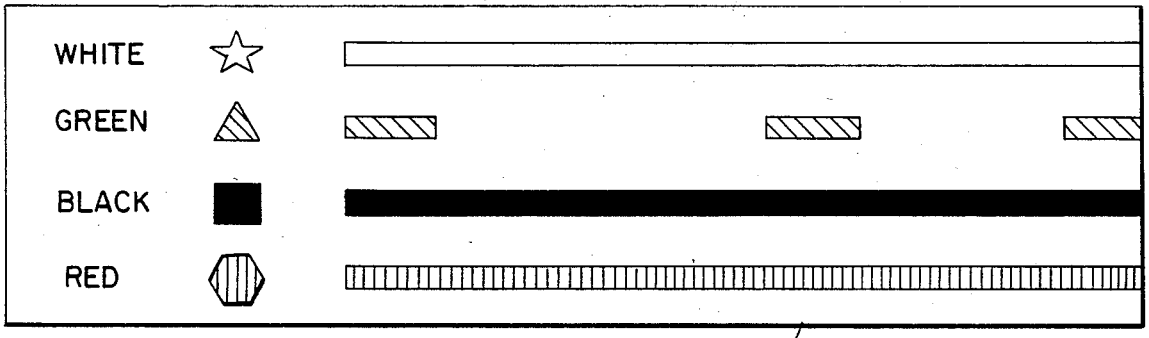

FIGS. 17, 18 and 19 show portions of flat cable in accordance with the invention which conform to electrical code standards and are usable in connection with the connector assembly described above. The three types of cable 120, 121 and 122 each include a conductor which is coded "white" and a conductor which is coded "green" as illustrated by the shading in the drawings. Cable 122 also has conductors which are coded "black" and "red". However, cable 120 has only the "black" coded conductor and cable 121 has the "red" conductor. It will further be observed that cables 121 and 122 are the same width and that the center-to-center spacing between conductors is an integral multiple of the distance D between the centers of the backing members retained in body 85, as illustrated in FIG. 7, and between the centers of holes 47 in body 45.

It is this spacing relationship which permits the connector assembly including bodies 45 and 85 to be used to form branch circuits wherein power can be supplied on a four conductor cable such as cable 122 and coupled to branch cables such as cable 120 or cable 121, or both, without there being difficulties in making connections with the wrong conductors. It is, of course, also possible to connect one cable 122 with another cable 122.

Figure 20:
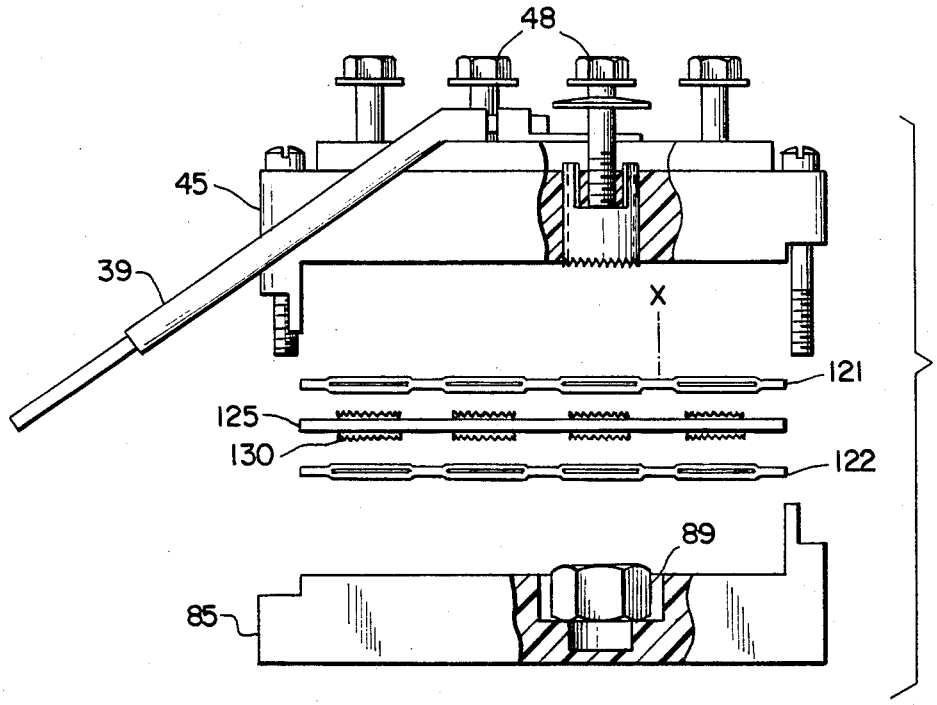
FIG. 20 is an exploded side elevation of a further embodiment of an apparatus in accordance with the invention.
Figure 21:
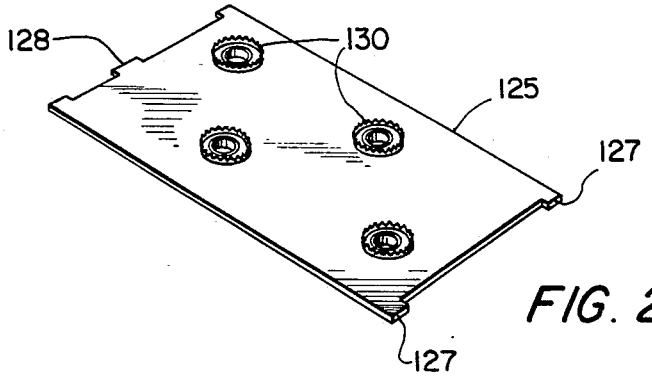
FIG. 21 is a perspective view of a bidirectional puncturing assembly usable in the apparatus of FIG. 20.
Figure 22:
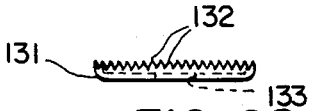
FIG. 22 is a side elevation of a puncturing member used in the structure of FIG. 21.

The discussion of the connector assembly above assumed only the connection of a cable to a receptacle or other such device. In order to complete interconnections between cables, an intermediate connection board is to be used. This is illustrated in FIG. 20 wherein bodies 45 and 85, with their associated components are the same and will not be further described. As seen in FIG. 20, a cable 121 is to be connected with a cable 122, and this connection will be accomplished using an intermediate connection board 125. Board 125 is shown in perspective in FIG. 21 as having a generally rectangular shape with alignment tabs 127 at the corners thereof. These alignment tabs extend on opposite sides of tabs 58 and 100. In addition, an intermediate tab 128 is provided, this tab being positioned to enter opening 112 in body 85, illustrated in FIG. 10. Board 125 is provided with puncturing connection members 130 protruding on opposite sides of the board, each member 130 including a dish-shaped member 131 with a serrated edge 132 and a central opening 133 through which bolt 48 can pass. Two dish-shaped members 131 are placed on opposite sides of board 125 in alignment with openings through the board and are fastened in that position by a conventional hollow rivet to form a connection member 130.

When forming an assembly such as that illustrated in FIG. 20, cable 122 is positioned on surface 87 of a body 85 and board 125 is placed on top of the cable with its tab 128 in opening 112. Cable 121 is then placed on top of the board and body 45 is placed over that assembly with the mounting openings and tabs aligned. Bolts 48 are then threaded into body 45, the bolt protruding out of the lower end and the drill point thereof forming an opening in the upper cable, passing through the rivet in the center of a connection member 130 in the interconnection board, and then forming an opening through the lower cable, after which the threaded portion 72 of the bolt engages the internal threads of nut 89. This is performed for each of bolts 48 until they are sufficiently tight. At this point, it will be observed that a connection has been formed between the white conductors in cables 121 and 122 with the white wire attached to the left-hand bolt 48 in body 45, and the same is true for the green or ground wires and the red wires. However, while a connection is formed between wire 39 and the black conductor in cable 122, wire 39 is not connected to anything in cable 121 because that portion of the cable simply does not have a conductor. It will be readily recognized that if a cable 120 were positioned in place of cable 121 in FIG. 12, that cable would extend only to point X marked on FIG. 20, the right-hand red conductor thereof being absent. Furthermore, it will be recognized that the spacing tab on body 45 would function in that circumstance to position the right-hand edge of the three-conductor cable so that the conductors thereof will be aligned with the left-hand three bolts 48 in body 45 and the associated serrated members 130 in the connection board. Thus, it will be recognized that the spacing arrangement illustrated in the cables of FIGS. 17–19 is particularly important to the successful operation of the connector assembly described herein, and that features of the connector assembly are necessary in order to maintain the appropriate alignment and spacing of the cables as they are placed in the connector assembly for electrical connection to external wires and to each other.

Figure 23:
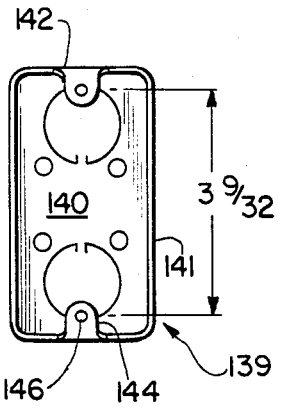
FIG. 23 is a front elevation of a conventional outlet box.

Because of these dimensional relationships, the transition unit assembly of the present invention can be employed in an outlet box mounted in a wall or other location. A standard single-device outlet box 139, sometimes referred to as a "handy box" as shown in FIG. 23, has a back wall 140, side walls 141 and end walls 142, the front side being open. Walls 140–142 have one-half inch or three-quarter inch knockouts formed in them so that conduit or cables can be attached in a conventional manner as is well-known to practicing electricians. The front space is open except for mounting tabs 144 which are usually formed integrally with end walls 142 and are bent to extend toward each other, parallel with back wall 140. Each tab 144 has a threaded hole 146 therethrough which is tapped to receive a number 6-32 screw. The centers of holes 146 are 3.281 inches (3+9/32 inches) apart. The type of box illustrated is a single gang box although a single or two gang box may be used as long as the mounting tabs 144 extend inwardly.

Figure 24:
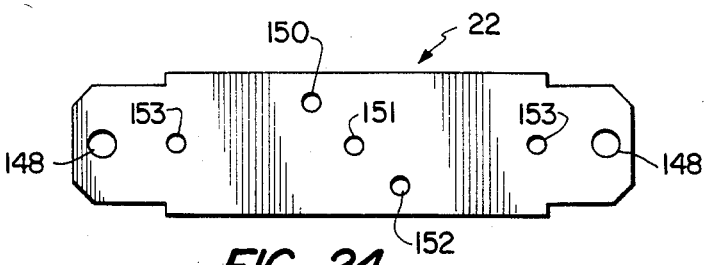
FIG. 24 is a top plan view of a mounting plate in accordance with the invention.
Figure 25:
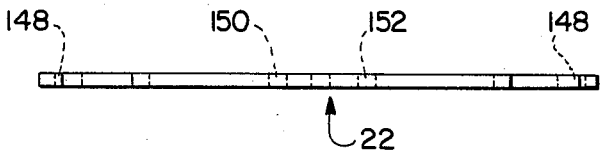
FIG. 25 is a side elevation of the plate of FIG. 24.

Plate 22, described in connection with FIGS. 1–3, is shown in more detail in FIGS. 24 and 25 and will be seen to have end holes 148 (preferably unthreaded) the centers of which are 3.281 inches apart so that the plate can be attached across the open side of a box 139. Plate 22 also has holes 150, 151 and 152 arranged along a diagonal line extending across the center of the plate.

Referring again to FIGS. 7 and 8, it will be recalled that body 85 is provided with mounting holes 110 lying on a diagonal line passing through or near the center of the back surface of that body. Holes 150 and 152 are positioned to be alignable with holes 110 and are internally threaded to receive screws passing through openings 110 with the screw heads in recesses 108 and 109.

Figure 26:
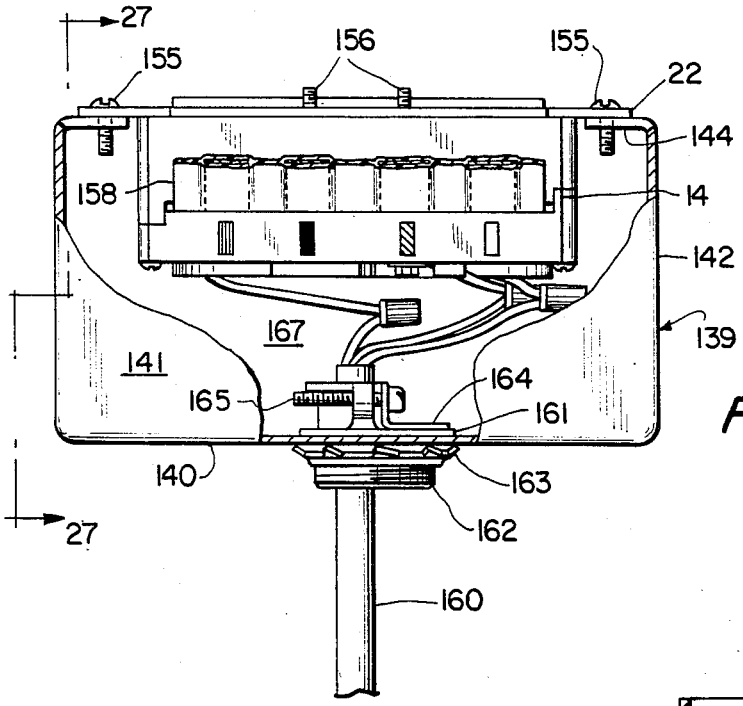
FIG. 26 is a side elevation of an outlet box with a transition unit assembly therein in accordance with the invention.
Figure 27:
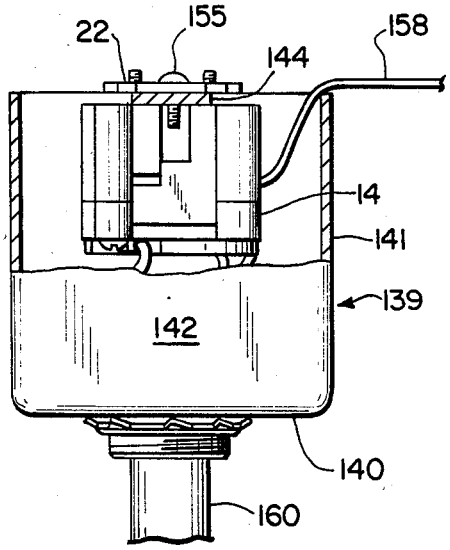
FIGS. 27 and 28 are end elevation and top plan views, respectively, of the apparatus of FIG. 26.
Figure 28:
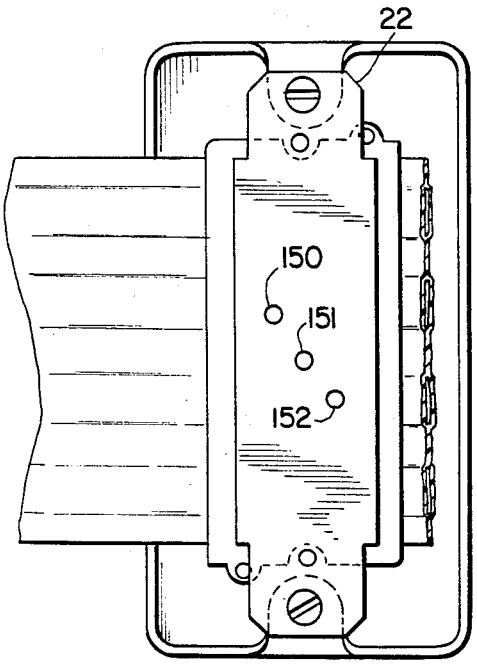

A transition unit can thus be mounted in a standard outlet box as illustrated in FIGS. 26, 27 and 28 in which plate 22 is connected across the open side of a box 139 and connected to tabs 144 by screws 155 which extend through the plate and are threaded into holes 146.

A transition unit 14 is mounted on plate 22 by screws 156 extending through holes 110 and threaded into holes 150 and 152, the ends of the screws being visible in FIGS. 26 and 27. A flat cable 158 extends through the center of the transition unit between bodies 45 and 85 and is bent toward the open face of the box so that the side thereof can extend along the surface of a wall or the like in which the box is mounted. It will be recognized that boxes of this type can be mounted in a variety of circumstances, and no effort will be made here to describe those various ways since they are well known to those skilled in the art. The extension of cable 158 from one side of box 139 can be covered by a top grounding plate or shield (not shown) and baseboard trim.

A cable 160, which is illustrated as a plastic-covered cable although conduit or other forms of cables can certainly be used, is connected through an opening in the back wall 140 of box 139 from which a knockout has been removed, using a standard cable connector of the type having an interior flange 161, an exterior threaded portion 162 and a star nut 163 to hold the connector in place in the back of the box. The cable 160 extends through the connector and is clamped therein by a clamping member 164 and clamping screws 165. Wires 167 extending from within the cable are connected by wire nuts to wires extending from terminals on the face of body 45 as described in connection with FIG. 6. Cable 160 can either be a supply to cable 158 through the transition unit or vice versa. A conventional blank cover plate, not shown, can be attached to plate 22 to conceal that plate and the openings at the sides thereof, the cover plate being attached by a center screw threaded into hole 151 in plate 22 or using two end screws passing into threaded holes 153 in plate 22, presenting a pleasing appearance.

Figure 29:
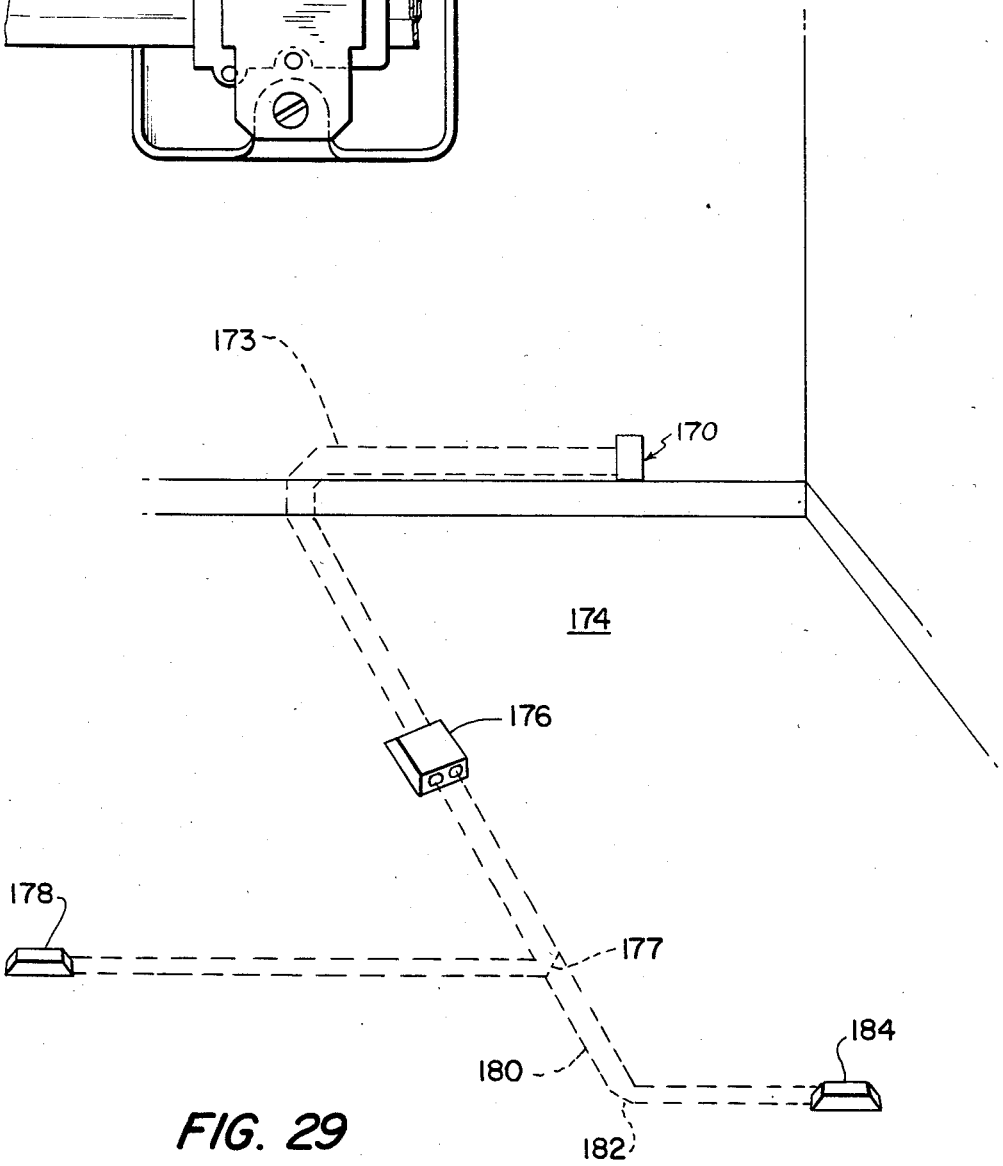
FIG. 29 is a schematic perspective view of a structure including apparatus in accordance with the invention.

A typical arrangement making use of the devices of the present invention is rather schematically illustrated in FIG. 29 in which a wall box assembly such as that illustrated in FIGS. 26–28 is identified as 170, a flat cable 172 extending from only one side thereof down the surface of a wall, and beneath the base molding 173, and extends across the floor beneath the carpet 174. At a location for a desk or the like, the cable enters a housing 176 containing a transition unit 14, as shown in FIGS. 1–3, emerges from the other side and makes another right angle turn at 177. Finally, the cable terminates at another housing 178 at a location for another piece of office furniture.

At housing 176, cable 172 is joined to another cable 180 which extends beyond turning point 177 to a turning point 182 and is connected to a housing 184.

This relatively simple example illustrates how a system in accordance with the invention can be employed with great flexibility and convenience to locate power outlets wherever they are needed, without regard to the structural limitations of the building itself. From this, many of the other possibilities will be recognized.

While certain advantageous embodiments have been chosen to illustrate the invention it will be understood by those skilled in the art that various changes and modifications can be made therein without departing from the scope of the invention as defined in the appended claims.

What is claimed is:

1. An apparatus for making electrical connections to a flat cable of the type having a plurality of flat conductors lying in substantially the same plane in parallel, spaced relationship and covered by insulating material, the apparatus comprising a first body of dielectric material having a first surface;

a plurality of backing members carried by said first body, each of said backing members having a surface adjacent to and facing in the same direction as said first surface and having an internally threaded hole therein;

a second body of dielectric material having generally parallel second and third surfaces;

a plurality of puncturing members carried by said second body, each of said puncturing members having at one end thereof a toothed edge extendable beyond said second surface and having a driving edge at the other end thereof adjacent said third surface;

a plurality of elongated bolts, each of said bolts being dimensioned to extend through said second body and one of said puncturing members and including an enlarged head at one end, external threads at the other end dimensioned to threadedly engage the threads in one of said backing members, means defining a point at said threaded end for penetrating one of said flat conductors, and a non-threaded portion for receiving a wire connector; and spring washer means surrounding said non-threaded portion for exerting pressure against said driving edge of said one of said puncturing members, whereby said first and second bodies can be assembled with the flat cable between said first and second surfaces and with each of said bolts penetrating one of said conductors so that the threaded end thereof is threaded into one of said backing members and so that said bolt head acts through said washer means to press said toothed edge through one surface of the cable insulating material into electrical contact with one of said conductors, the other surface of said cable being held against one of said backing members.

2. An apparatus according to claim 1 wherein said second body includes a wall between said second and third surfaces with slots therein to receive said axial extensions and a threaded hole to receive said bolt.

3. An apparatus according to claim 1 wherein each of said puncturing members comprises a generally tubular body having said toothed edge at one end thereof and first and second axial extensions having said driving edges at the distal ends thereof.

4. An apparatus according to claim 1 wherein each of said backing members comprises an internally threaded polygonal nut, and wherein said first body includes means defining a plurality of polygonal recesses to receive said backing members and to restrain said backing members against rotation, and means in said recesses for permitting threedimensional movement of said backing members.

5. An apparatus according to claim 1 wherein said means defining a point comprises an inwardly extending cavity therein for receiving insulation severed by said means.

6. An apparatus according to claim 1 and further comprising an intermediate connection board including a plurality of conductive connectors arranged to be aligned with said backing members, each of said conductive connectors having oppositely facing toothed edges, said intermediate board being positionable between cables and between said first and second bodies to interconnect conductors in said cables.

7. An apparatus according to claim 1 wherein said plurality of backing members are spaced apart so that the centers of the holes therein are in planes passing perpendicularly through flat conductor locations in said cable.

8. An apparatus according to claim 7 wherein said second body includes a wall between said second and third surfaces with slots therein to receive said axial extensions and a threaded hole to receive said bolt.

9. An apparatus according to claim 7 wherein said backing members are offset from each other in the longitudinal direction of said cable and wherein said puncturing members and said bolts are arranged in said second body in alignment with said backing members.

10. An apparatus according to claim 9 wherein each of said backing members comprises an internally threaded polygonal nut, and wherein said first body includes means defining a plurality of polygonal recesses to receive said backing members and to restrain said backing members against rotation.

11. An apparatus according to claim 10 wherein each of said puncturing members comprises a generally tubular body having said toothed edge at one end thereof and first and second axial extensions having said driving edges at the distal ends thereof.

12. An apparatus according to claim 11 wherein said second body includes a wall between said second and third surfaces with slots therein to receive said axial extensions and a threaded hole to receive said bolt.

13. A flat cable connection system comprising the combination of flat cable means for connection to a source of power and to load devices including flat cable of a first type having four flat conductors embedded in insulation therein and a substantially constant, predetermined overall width, said conductors being substantially parallel with each other and having substantially uniform center-to-center spacing, flat cable of a second type having three flat conductors embedded in insulation therein, said conductors being substantially parallel with each other, two of said conductors having the same center-to-center spacing as the conductors in said first cable type and the third conductor center being separated from the center of the closest of said two conductors by twice that distance, said second cable type having an overall width substantially equal to said first type; and flat cable of a third type having three flat conductors embedded in insulation therein and a smaller overall width than said cables of said first and second types, said conductors being substantially parallel with each other and having the same substantially uniform center-to-center spacing as said first cable type, each of the cables of each of said cable types having a longitudinal reference edge; and a transition unit for forming connections between a cable of one of said cable types and conventional wires leading to an electrical device or between cable of the first said cable types and another cable of one of said types, or both types of connections, said transition unit comprising a set of four connection assemblies, each said connection assembly comprising puncturing means for puncturing the insulation covering a conductor in at least one of said cables, and clamp means for pressing said puncturing means into said insulation and against the conductor; and body means for carrying said connection assemblies in a pattern with the same lateral center-to-center spacing as in cable of said first type and for receiving cable of any of said types with said reference edge at a location such that said connection assemblies are substantially centered on said conductors.

14. A system according to claim 13 and further comprising an intermediate connection board including a plurality of conductive connectors arranged to be aligned with said clamp means, each of said conductive connectors having oppositely facing toothed edges, said intermediate board being positionable cables and within said body means to interconnect conductors in said cables.

15. A system according to claim 13 wherein cables of each of said cable types includes indicia means for identifying the conductors therein by color code with the conductor closest to said reference edge being identified as white, the next adjacent conductor in cable of said first and third cable types as green and the next adjacent conductor in cable of said first and third types as black.

16. A system according to claim 15 wherein each of said clamp means includes a bolt having an enlarged head, a threaded portion and a pointed, drill-like tip, a backing member having a threaded hole to receive the threaded portion of said bolt, and a spring washer positionable between said enlarged head and said puncturing means, said clamp means being operative to extend through a wire terminal, drill through a cable conductor and clamp said puncturing means against said conductor.

17. A system according to claim 16 wherein each of said puncturing means comprises a generally tubular body having said toothed edge at one end thereof and first and second axial extensions having said driving edges at the distal ends thereof.

18. A system according to claim 17 and further comprising an intermediate connection board including a plurality of conductive connectors arranged to be aligned with said backing members, each of said conductive connectors having oppositely facing toothed edges, said intermediate board being positionable between cables and within said body means to interconnect conductors in said cables.

19. A method of forming an electrical connection with an insulated flat conductor in a flat cable comprising the steps of clamping a flat cable between first and second bodies of insulating material, threading a bolt having an enlarged head and a drill-like point through the first one of the bodies and into the insulation and conductive material of the conductor, thereby forming a hole through the conductor with the bolt passing therethrough, electrically connecting a wire to the bolt, threadedly engaging the end of the bolt in an internally threaded backing member carried by the second body, providing a puncturing member surrounding the bolt with teeth toward the conductor, the puncturing member being located between the conductor and the enlarged head of the bolt, and pressing the teeth of the puncturing member through the cable insulation and into the conductor by continuing to thread the bolt into the backing member until the conductor is tightly clamped between the puncturing member and the backing member.

20. A method according to claim 19 and further including providing a spring washer between the bolt head and the puncturing member to compensate for cold flow of cable insulation material between the conductor and backing member and to maintain the clamping force.

* * * * *